US005129357A

United States Patent [19]

Yamaji

[11] Patent Number: 5,129,357

[45] Date of Patent: Jul. 14, 1992

[54] MAGNETIC BRUSH DEVELOPING APPARATUS WHEREIN A POINT OF INFLECTION IN THE MAGNETIC FLUX DENSITY DISTRIBUTION IS PROVIDED UPSTREAM FROM THE MAXIMUM FLUX DENSITY POSITION

[75] Inventor: Masaaki Yamaji, Tokyo, Japan

[73] Assignee: Canon Kabushiki Kaisha, Tokyo, Japan

[21] Appl. No.: 640,866

[22] Filed: Jan. 14, 1991

[30] Foreign Application Priority Data

Jan. 12, 1990 [JP] Japan ..... 2-5696
Jan. 12, 1990 [JP] Japan ..... 2-5697

[51] Int. Cl.[5] ..... G03G 15/09

[52] U.S. Cl. ..... 118/658; 355/245; 355/251

[58] Field of Search ..... 118/653, 657, 658; 355/245, 251, 252, 253, 305; 430/120, 122

[56] References Cited

U.S. PATENT DOCUMENTS 4,449,810 5/1984 Ikesue et al. ..... 118/658 X
4,679,527 7/1987 Chang ..... 118/658
4,821,075 4/1989 Saito et al. ..... 118/657 X
4,911,100 3/1990 Yamashita ..... 118/658
4,916,492 4/1990 Hoshika et al. ..... 355/253
4,960,070 10/1990 Nishimura ..... 118/658
5,051,782 9/1991 Yamaji ..... 355/251
5,070,812 12/1991 Yamaji ..... 118/658

FOREIGN PATENT DOCUMENTS 0287873 11/1988 Japan ..... 355/253

*Primary Examiner*—A. T. Grimley
*Assistant Examiner*—Barlow, Jr., J. E.
*Attorney, Agent, or Firm*—Fitzpatrick, Cella, Harper & Scinto

[57] ABSTRACT

A magnet is disposed stationarily in a rotatable developing sleeve. The magnet at least has a developing magnetic pole and a conveying magnetic pole disposed adjacent to it and downstream of it. In the magnetic flux density distribution of the conveying pole, an inflection point is provided upstream of the maximum magnetic flux density position in the magnetic flux density distribution.

The point of inflection is defined as the point where the secondary differentiation of the magnetic flux density Br (gauss), which is $\delta^2 Br/\delta^2 \Theta$, equals zero. The result of setting the inflection point to such a position is an improvement of developer conveying power.

11 Claims, 6 Drawing Sheets

MAG FLUX DENSITY DISTRIBUTION

MAG FLUX DENSITY DISTRIBUTION

MAG FLUX DENSITY DISTRIBUTION

MAGNETIC BRUSH DEVELOPING APPARATUS WHEREIN A POINT OF INFLECTION IN THE MAGNETIC FLUX DENSITY DISTRIBUTION IS PROVIDED UPSTREAM FROM THE MAXIMUM FLUX DENSITY POSITION

FIELD OF THE INVENTION AND RELATED ART

The present invention relates to a developing apparatus usable with an image forming apparatus such as an electrophotographic copying machine or an electrostatic recording machine, more particularly to a developing apparatus using a developer containing magnetic material.

Various proposals have been made as to the developing apparatus using a developer containing magnetic material. Typical ones include a developer container containing a developer and a rotatable developer carrying member in the form of a non-magnetic cylinder which will hereinafter be called "sleeve", wherein the sleeve encloses a magnet roller stationarily disposed therein, the magnet roller having a plurality of a magnetic poles. In such a developing apparatus, the developer is carried from the inside of the developer container by the rotation of the sleeve to a developing zone where the latent image is developed. The magnet roller has a magnetic pole at a position of the developing zone wherein the sleeve is faced to the image bearing member to form a magnetic field (the magnetic pole will hereinafter be called "a developing magnetic pole". In addition, it includes another magnetic pole downstream of the developing magnetic pole with respect to the rotational direction of the sleeve to convey the developer having passed through the developing zone back into the container. Said another magnetic pole will be called hereinafter "a conveying magnetic pole".

If the conveying magnetic pole is disposed at a position outside the developer container, the developer erected by the conveying magnetic pole is scattered. In order to prevent the scattering, the conveying magnetic pole is usually disposed within the container or covered with a covering member.

To meet the recent demand for the high quality image, the size of the toner particles in a two component developer magnetic brush type development is selected which provides high resolution and fine quality images. However, simply by reducing the size of the toner particles, result in the toner supply power decrease. Therefore, it becomes necessary to reduce the size of the magnetic carrier particles. When the size of the magnetic carrier particles is reduced, they are more easily deposited on the image bearing member and are therefore taken out of the developing apparatus. In order to prevent this, the magnetic flux density of the developing magnetic pole is increased to exceeding 900 Gausses on the sleeve, and even exceeding 1000 Gausses. This necessitates that the magnetic flux density of the conveying magnetic pole is relatively smaller than that of the developing magnetic pole.

However, in the conventional apparatus, the developer conveying property is worsened because of the smaller maximum magnetic flux density of the conveying magnetic pole as compared with the maximum magnetic flux density of the developing magnetic pole. Then, the developer stagnates in the neighborhood of the developing zone, or the developer is not sufficiently returned into the developer container but overflows. In addition, the quality of the image is degraded, or the developer is scattered. Those problems tend to arise more when the two component developer containing a small size carrier and toner particles, and when the conveying magnetic pole is covered with the covering member.

It is known that the polarity of the conveying magnetic pole (first conveying magnetic pole) and the polarity of the downstream magnetic pole (second magnetic pole) are made the same, so that a repelling magnetic field is formed therebetween, by which the developer on the sleeve is once removed. Thereafter, a fresh developer is applied on the sleeve. By doing so, the image quality can be stabilized. However, such a repelling magnetic field deteriorates the developer conveying power of the first conveying magnetic field.

SUMMARY OF THE INVENTION

Accordingly, it is a principal object of the present invention to provide a developing apparatus wherein the developer conveying property is improved, and the developer is effective prevented from scattering.

It is another object of the present invention to provide a developing apparatus wherein the developer conveying property is improved, and the defects in the image can be prevented.

The developing apparatus according to an embodiment of the present invention, similarly to the conventional developing apparatus, comprises a developing magnetic pole and a conveying magnetic pole which is downstream of the developing magnetic pole with respect to the rotational direction of the developer carrying member and which is adjacent to the developing magnetic pole.

According to the embodiment of the present invention, the magnetic flux density distribution of the conveying magnetic pole has an inflection point at a position upstream of the maximum magnetic flux density position. It has been confirmed that such a conveying magnetic pole as providing the inflection point, is effective to improve the developer conveying power.

The inventors think that this is because of the influence by the magnetic force in the tangential direction along the developer carrying member by the conveying magnetic pole, more particularly, it is because the magnetic force of the first conveying pole is shifted in the direction of the conveyance.

Other object and advantages of the invention will become apparent from the following description of the embodiment of the present invention in conjunction with the accompanying drawings.

DESCRIPTION OF THE PREFERRED EMBODIMENTS

Figure 1:
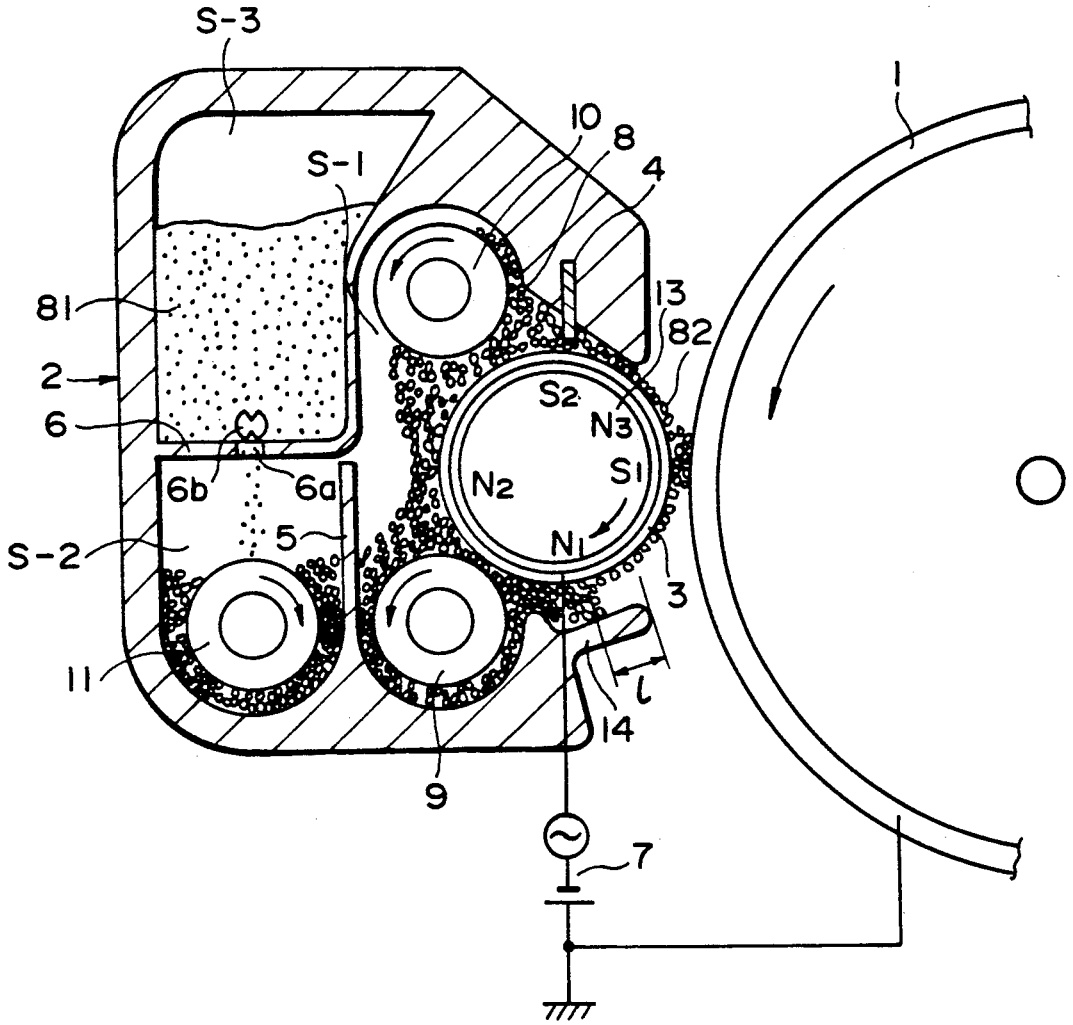
FIG. 1 is a cross-sectional view of an apparatus according to an embodiment of the present invention.

Referring to FIG. 1, there is shown a developing apparatus according to an embodiment of the present invention. On electrophotographic photosensitive drum 1 is rotatable in the direction indicated by an arrow. Around the photosensitive drum, there are disposed known electrophotographic process means including a charger, an image exposure means, an image transfer means, a cleaning means and electric discharge means. Those means are known and omitted from FIG. 1 for the sake of simplicity.

The magnetic brush type developing apparatus 2 in this embodiment functions to develop a latent image formed on the photosensitive drum 1. It comprises a developer container 2 containing the developer 8, a developing sleeve 3 functioning as the developer carrying member and a blade 4 for regulating the thickness of the developer layer formed on the sleeve 3.

The developer container 2 is provided with an opening, in which the developing sleeve 3 is rotatably supported, and adjacent the upper part of the developing sleeve 3, the blade 4 is mounted with a predetermined clearance from the sleeve 3.

The developing sleeve 3 is made of non-magnetic material, and it rotates in the direction of arrow in FIG. 1 during the developing operation to carry the developer thereon. Within the sleeve 3, a magnet 13 is stationarily disposed. The magnet 13 has magnetic poles S1, N1, N2, S2 and N3 in the order named along the rotational direction of the sleeve. Here, the reference character including "S" means that it is an S pole, and "N" means that it is an N pole. The magnetic polarities of the magnetic poles may be opposite from those shown in the Figure.

The magnetic pole S1 is the developing magnetic pole to form a magnetic field in the developing zone. The magnetic field forms a magnetic brush of the developer contacted to the photosensitive drum 1 in the developing zone. In the present invention, in order to suppress the carrying-over of the carrier particles by the deposition onto the drum 1, it is preferable that the maximum magnetic flux density by the magnetic pole S1 on the sleeve surface is greater than 900 Gauss, and preferably greater than 1000 Gauss. The magnetic pole N1 is the conveying pole for conveying the developer which passed through the developing zone. Because the maximum magnetic flux density of the magnetic pole S1 is great, the maximum magnetic flux density of the pole N1 on the sleeve surface is smaller than that of the pole S1. The magnetic pole N2 functions to attract the developer in the container onto the sleeve 3 surface. The magnetic poles S2 and N3 are effective to convey the developer toward the developing zone.

The blade 4 is made of non-magnetic material such as aluminum, and is mounted to the container with a predetermined clearance from the surface of the developing sleeve 3, as described hereinbefore. The clearance functions to regulate the thickness of the developer 8 layer on the developing sleeve 3, that is, the quantity of the developer 8 conveyed to the developing zone on the developing sleeve 3. In this embodiment, the developer 8 is a two component developer comprises non-magnetic toner particles 81 and magnetic carrier particles 82, and therefore, both of the non-magnetic toner particles and magnetic particles are passed through the clearance between the free end of the blade 4 and the developing sleeve 3 surface, toward the developing zone.

In the present invention, the layer of the developer is preferably thin. Therefore, the preferable clearance between the blade 4 and the sleeve 3 surface is 50–900 microns. If it is smaller than 50 microns, the developer is more easily clogged in the clearance with the result of non-uniform thickness developer layer, and on the other hand, if it is larger than 900 microns, the quantity of the developer discharged from the container to large with the result that the quantity of the carrier particles deposited on the drum 3 and is taken out of the developing apparatus tends to increase in the case wherein an alternating electric field is formed in the developing zone.

The non-magnetic toner 81 preferably has a volume average particle size of not more than 8 microns and not less than 4 microns. In this embodiment, the used toner had the volume average particle size of approximately 8 microns. The volume average particle size is measured by the Coulter Counter TA-II (available from Coulter Electronics Incorporated) using an aperture of 100 microns, for example.

The counter is connected with an interface (available from Nikkaki Kabushiki Kaisha, Japan) outputting the number average distribution and volume average distribution, and is connected with CX-i personal computer (available from Canon Kabushiki Kaisha, Japan). A 1% NaCl water solution is prepared using a first class natrium chloride.

Into 100–150 ml of the electrolytic solution, 0.1–5 ml of a surface active agent as the dispersing agent, preferably an alkylbenzene sulfonate acid salt, is added, and 0.5–50 mg of the material to be tested is added thereto. The electrolytic solution suspending the material to be tested is subjected to a dispersion treatment for approximately 1–3 min. by an ultrasonic disperser. The above-mentioned counter is used with an aperture of 100 microns to measure the particle size distribution in the range of 2–40 microns, and the volume average distribution is obtained.

From the volume average distribution, the volume average particle size can be obtained.

When the toner 81 described above is used, the magnetic carrier particles 82 having the weight average particle size of 20–65 microns are usable. In this embodiment, the weight average particle size of the magnetic particles used was approximately 50 microns. The weight average particle size is measured using a mesh. The particles passed through 300/400 mesh were 80%, and the particles passed through 300/350 mesh were 75%. The magnetic particles are made of ferrite particles coated with extremely thin resin material, and the specific permeability was 5.0.

To the developing sleeve 3, an oscillating bias voltage is applied from the voltage source 7. The oscillating bias voltage has two peaks such that the light portion potential and the dark portion potential of the latent image are between the two peaks. Preferably, the oscillating bias voltage is biased with a DC voltage having a voltage level between the light portion potential and the dark portion potential of the latent image. By the application of the alternating bias voltage, an electric field having alternating direction in short periods is formed in the developing zone. As a result of this application the toner and carrier particles are vibrated, by which the release of the toner particles from the surfaces of the carrier particles. Additionally the surface of the sleeve 3 are promoted, so that the development efficiency is increased.

As described hereinbefore, in the oscillating electric field, the end portions of the magnetic brush contacted to the drum in the developing zone tends to be torn with the result that small diameter carrier particles are easily deposited and retained on the photosensitive drum. In order to prevent this, it is desired that the maximum magnetic flux density of the developing magnetic pole S1 is increased. If this is done, the developer conveying power decreases. However, the present invention makes it possible to avoid this.

The developer having passed through the developing zone is carried on the sleeve 3 to the conveying magnetic pole N1.

The developing apparatus is provided with a covering member 14 which is disposed with a predetermined clearance from the developing sleeve 3 surface and is extended upstream to the position where the magnetic flux density on the sleeve by the conveying pole N1 is maximum. In this embodiment, the distance 1 from the end of the covering member 14 and the maximum magnetic flux density position by the conveying pole N1 is 7 mm.

The developer formed into the magnetic brush by the conveying pole N1 is sufficiently covered by the covering member 14, so that the developer is prevented from scattering out side the developer container.

In FIG. 1, the conveying pole N1 and the immediately downstream second conveying pole N2 have the same magnetic polarity so that a repelling magnetic field is produced therebetween. Therefore, the developer conveyed to the conveying pole N1 on the sleeve 3 is removed from the sleeve 3 by the repelling magnetic field. The developer is stirred and mixed by the first conveying means 9, and thereafter, a fresh developer is supplied onto the sleeve 3 surface adjacent the magnetic pole N2.

Thus, the developer on the sleeve which has the development hysteresis is removed from the sleeve surface by the repelling magnetic field, and is sufficiently mixed with the fresh developer, and they are supplied onto the sleeve 3. Accordingly, stabilized and good images can be provided.

The inside of the developer container 2 is partitioned by a wall 5 extending in the direction perpendicular to the sheet of the drawing into a developer chamber (first chamber) S-1 and a stirring chamber (second chamber) S-2. Above the stirring chamber S-2, a toner accommodating chamber S-3 is defined by a partition wall 6. In the toner containing chamber S-3, a supply of toner (non-magnetic toner particles) 81 is contained. In the partition wall 6, a supply port **6*a* is formed. Through the support 6*a*, an amount, corresponding to the amount of the toner consumed by the developing operation, of the toner is supplied from the toner accommodating chamber S-3 to the stirring chamber S-2 by a toner supply roller 6*b*. In the developing chamber S-1 and the stirring chamber S-2, the developer 8 is accommodated. Adjacent the front and rear sides of the developer container 2 in FIG. 1, openings (not shown) are formed to provide communication between the developing chamber S-1 and the stirring chamber S-2**.

In the developing chamber S-1, there are first conveying means 9 and second conveying means 10. The first conveying means 10 is disposed at the bottom of the developer container 2 adjacent to the developing sleeve 3 and is rotatable in the direction of an arrow to convey the developer 8 from the rear side to the front side in FIG. 1. The second conveying means 10 is disposed above the first conveying means 9 and rotates in the direction indicated by an arrow to convey the developer 8 from the front side to the rear side in FIG. 1.

In the stirring chamber S-2, third conveying means 11 is provided which is disposed substantially at the same horizontal level as the first conveying means and is rotatable in the direction indicated by an arrow to convey the developer 8 from the front side to the rear side in FIG. 1.

The first, second and third conveying means 9, 10 and 11 are in the form of spiral screws.

Figure 2:
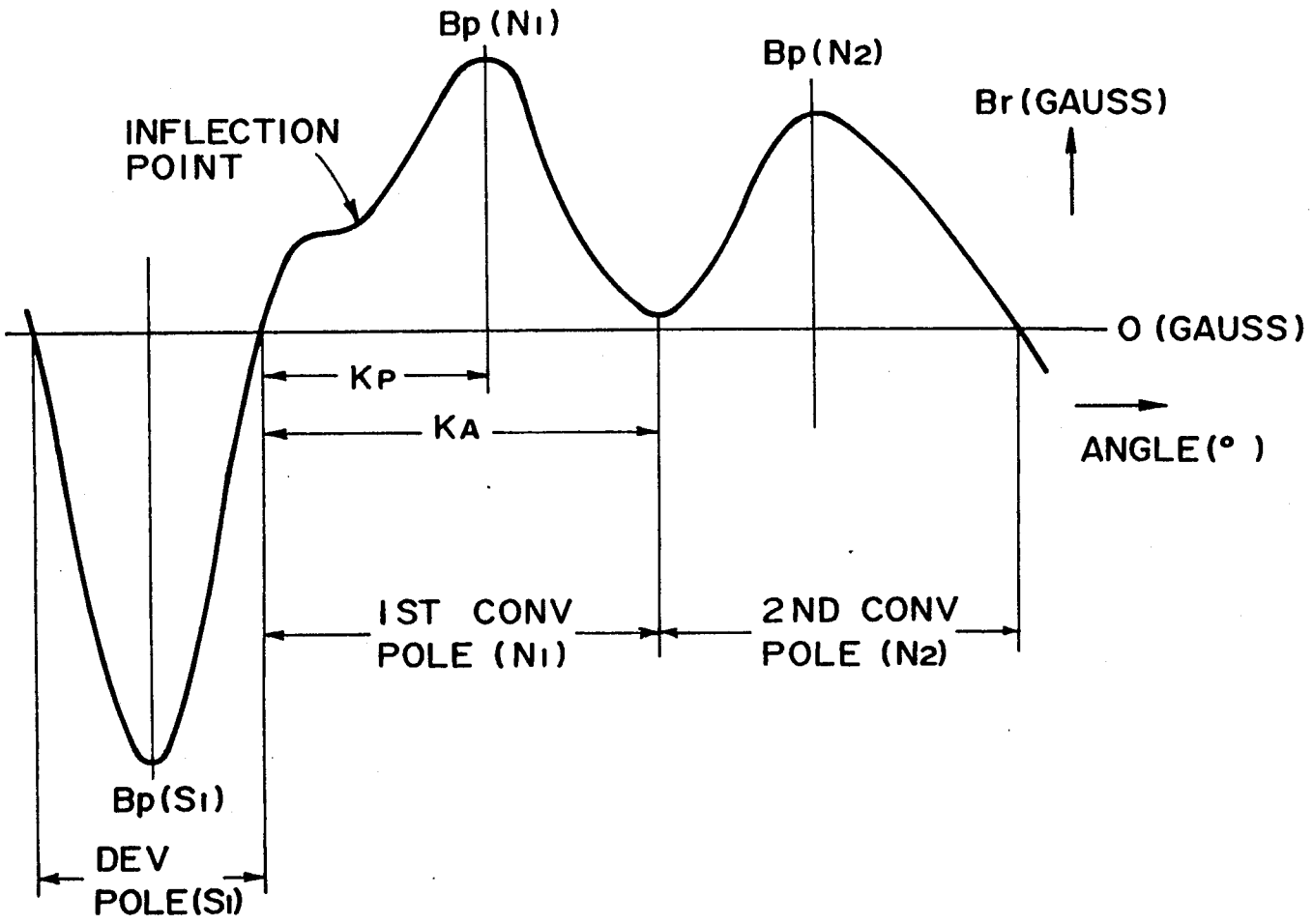
FIG. 2 shows an example of a magnetic flux density distribution of a magnet used in the apparatus of FIG. 1.

The magnetic flux density distributions in the Examples of FIG. 1 are as shown in FIG. 2. In FIG. 2, the ordinates represent the magnetic flux density on the developing sleeve 3, and the abscissa represents the circumferential position along the developing sleeve 3 surface by an angle as seen from the center of the sleeve.

The magnetic flux density referred to in the description in conjunction with FIG. 2 and FIG. 8 which will be described hereinafter is defined as the magnetic flux density in the direction perpendicular to the surface of the sleeve 3, that is, the developer carrying member.

Here, the description will be made as to the definition of the magnetic pole. In the case of the developing magnetic pole of which adjacent magnetic poles at its either sides have the opposite polarity, the developing magnetic pole is defined as the region between the position which is upstream of the maximum magnetic flux density position Bp (S1) of the developing magnetic pole in which the magnetic flux density is 0 Gauss and the position which is downstream of the maximum magnetic flux density position Bp (S1) by the developing magnetic pole in at which the magnetic flux density is 0 Gauss. In the case of the conveying magnetic pole of which one of adjacent magnetic pole (downstream, for example) has the same polarity, the conveying magnetic pole is defined by a region between a position which is upstream of the maximum magnetic flux density position Bp (N1) by the conveying magnetic pole in which the magnetic flux density is 0 Gauss and a position which is downstream of the maximum magnetic flux density position Bp (N1) by the conveying magnetic pole in which the magnetic flux density is minimum.

In other words, where the adjacent magnetic poles have the opposite polarity, the boundary is the 0 Gauss position of the magnetic flux density. Where the adjacent magnetic pole has the opposite polarity, the boundary is the position of the minimum magnetic flux density in the absolute value.

In the graph, the magnetic flux density Br of the N-pole is expressed as positive, and the magnetic flux density of the S-pole is expressed as negative.

In FIG. 2, $K_A$ is the influential region of the first magnetic field N1 expressed as an angle $K_P$ is the angle formed between the upstream boundary of the first conveying magnetic pole N1 and the maximum magnetic flux density position $B_P$(N1) of the first conveying pole.

The description will be made as to the configuration of the first magnetic flux density distribution of the first conveying magnetic pole N1. As shown in that figure, there is an inflection point upstream of the maximum magnetic flux density position BP(N1) of the first conveying magnetic pole, with respect to the rotational direction of the sleeve. The inflection point is the point where the secondary differentiation of the magnetic flux density Br, that is, $\theta^2 Br/\theta^2\theta$, is 0.

Inventors' experiments have revealed that if the inflection point is set upstream of the the maximum magnetic flux density point $B_P$(N1) of the first conveying magnetic pole, the developer conveying power at the position of the first conveying pole is improved. The reason for this is considered to be the influence of the magnetic force in the tangential direction on the developing sleeve 3 at the position of the first conveying pole, more particularly, the shift of the magnetic force of the first conveying pole is shifted in the direction of the developer conveyance, and in the direction of the rotational direction of the sleeve.

Figure 3:
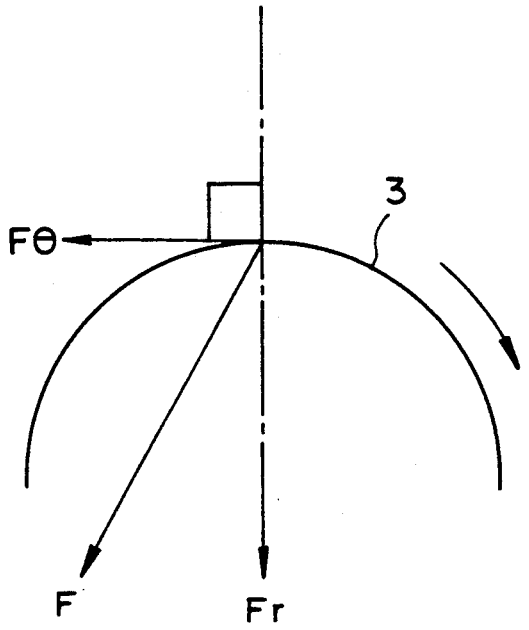
FIG. 3 illustrates magnetic forces according to the present invention.

Referring to FIG. 3, the description will be made as to the magnetic force on the developing sleeve. In FIG. 3, F is a magnetic force [newton] on the developing sleeve 3, Fr is a magnetic force [newton] in the direction perpendicular to the surface of the sleeve, F$\theta$ is the magnetic force in the tangential direction of the sleeve. The direction of the forces are expressed as negative if they are codirectional, and is expressed as positive if they are counterdirectional. The magnetic force F$\theta$ [newton] is:

$$F\theta = -\frac{\mu r - 1}{\mu r + 2} \times \frac{2\pi b^3}{\mu o} \times 10^{-23} \times \frac{\partial B^2}{\partial \theta}$$

$$B^2 = Br^2 + B\theta^2$$

$$\frac{\partial B^2}{\partial \theta} = \frac{B^2(\theta + \Delta\theta) - B^2(\theta - \Delta\theta)}{2\Delta\theta}$$

where magnetic permeability in vacuum, $4\pi \times 10^{-7}$ [H/M]

$\mu$r: specific magnetic permeability of magnetic particles b radius of magnetic particles [micron]

Br magnetic flux density on the ds in the radial (perpendicular) direction [gauss]

B$\theta$: magnetic flux density on the developing sleeve in the tangential direction [gauss]

The force F$\theta$ is obtained using the above formulas for the case in which the inflection point of the magnetic flux density is disposed upstream of the maximum magnetic flux density position in the first conveying pole and for the case in which it is not. It has been revealed that the minimum F$\theta$min of the force F$\theta$ tends to be smaller when the inflection point is so disposed than when it is not. In some cases, the force F$\theta$min is negative. In other words, the F$\theta$ is positive when the inflection point does not exist. This means that there is a magnetic force in the direction opposite from the sleeve surface movement direction. The fact that the force F$\theta$ is made smaller by the provision of the inflection point means that the developer retracting force is reduced, that is, the developer conveying power is relatively increased. The negative F$\theta$ means the application of the force enhancing the conveyance of the developer. The above is considered to be the reason for the improvement of the conveying power.

In this embodiment, the conveying magnetic pole immediately downstream of the developing pole is covered with a covering member 14 for the purpose of preventing the toner scattering, but this is not good for the developer conveying performance. In addition, the magnetic flux density of the developing pole is made larger for the purpose of preventing the production of the foggy background and the prevention of the carrier deposition prevention. Therefore the flux density of the conveying pole is fairly smaller than that of the developing, pole and the arrangement is such that the developer in the conveying pole is not easily conveyed.

In such an arrangement, the configuration of the magnetic flux density distribution by the conveying pole has been found to be significant. It has been found through experiments that by the provision of the inflection point of the magnetic flux density upstream of the position $B_P$(N1) in the magnetic flux density distribution, the conveying power for the developer by the fcmp is improved.

Furthermore, by providing the negative component with the magnetic force F$\theta$, that is, with the component in the direction of the sleeve movement, the developer conveying power by the first conveying pole is very much improved.

An example of obtaining the magnetic force F$\theta$ will be described. The magnetic flux density Br in the radial direction on the developing sleeve 3 and the magnetic flux density B$\theta$ in the tangential direction are measured by a Gauss meter available from Bell, incorporated. Here, $\theta$ is an angle [radian] from a reference position $\theta_0$. The angle $\theta$ is larger toward the downstream with respect to the rotational direction.

The description will be made further with respect to $(\partial Br^2)/\partial\theta)$.

If the differentiation is made from the positive side, $$\frac{\partial B^2}{\partial \theta} = \lim_{\Delta\theta \to 0} \frac{B^2(\theta + \Delta\theta) - B^2(\theta)}{\Delta\theta} \quad (1)$$

If the differentiation is made from the negative side, $$\frac{\partial B^2}{\partial \theta} = \lim_{\Delta\theta \to 0} \frac{-B^2(\theta - \Delta\theta) + B^2(\theta)}{\Delta\theta} \quad (2)$$

Because of the structural continuance, they are deemed equal, then, $$2 \times \frac{\partial B^2}{\partial \theta} = \lim_{\Delta\theta \to 0} \frac{B^2(\theta + \Delta\theta) - B^2(\theta - \Delta\theta)}{\Delta\theta}$$

therefore, $$\frac{\partial B^2}{\partial \theta} = \lim_{\theta \to 0} \frac{B^2(\theta + \Delta\theta) - B^2(\theta - \Delta\theta)}{2\Delta\theta} \quad (3)$$

If the calculation is made for each of 3 degrees of the angle $\Delta\theta$, then $\theta$ is $3\pi/180$.

Therefore, $$\frac{\partial B^2}{\partial \theta} = \frac{B^2(\theta + \Delta\theta) - B^2(\theta - \Delta\theta)}{2\Delta\theta} \quad (4)$$

where $\theta = 3\pi/180$.

An example of calculation of the magnetic force $F\theta$ [newton] will be described. It is assumed that the radius b of the magnetic particles is 25 microns; the permeability ur of the magnetic particles is 5.0; the magnetic flux density Br and $B\theta_d$ are as follows at the position $\theta$ measured from the reference position.

| Position | $\theta_d$ (degree) | Br (gauss) | $B\theta$ (gauss) |
|---|---|---|---|
| | 207 | 118 | 852 |
| A | 210 | 14 | 805 |
| B | 213 | 62 | 745 |
| C | 216 | 116 | 695 |
| | 219 | 158 | 646 |

In order to obtain $F\theta$ at position A $(Br^2)/(\theta)$ is obtained.

At the position −3 degrees from the position A, Br and $B\theta$ are 118 G and 852 G; and at the position +3 degrees from the position A, Br and $B\theta$ are 62 G and 695 G. If they substitute in the equation (4), $$\frac{\partial B^2}{\partial \theta} = \frac{(62^2 + 745^2) - (118^2 + 852^2)}{2 \times 3\pi/180} = \frac{30}{\pi}[(62^2 + 745^2) - (118^2 + 852^2)]$$

If the above $(\partial Br2)/(\partial\theta)$, b=25, $\mu r=5.0$ and $\mu o=4\pi\times10^{-7}$ are added, $$F\theta = \frac{5.0-1}{5.0+2} \times \frac{2\pi \times 25^3}{4\pi \times 10^{-7}} \times 10^{-23} \times \frac{30}{\pi}[(62^2 + 745^2) - (118^2 + 852^2])$$

$$= 7.71 \times 10^{-7} \text{ [newton]}$$

Similarly, the force $F\theta$ at the position B is $F\theta=6.78\times10^{-7}$ [newton]

The method of measuring the magnetic flux density will be described. A Gauss meter model 640 and an axial probe model 4-1802, both available from Bell, Incorporated are used.

Figure 4:
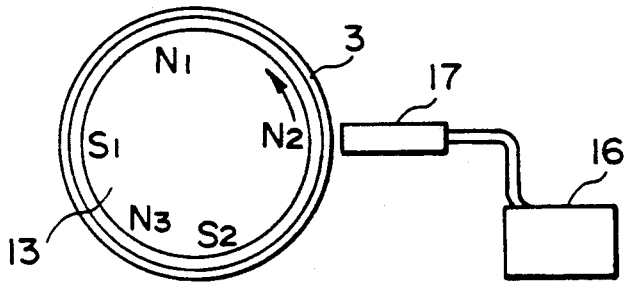
FIG. 4 illustrates a measuring method of a magnetic flux density in the direction perpendicular to the surface of the sleeve.

FIG. 4 illustrates measurement of the radial magnetic flux density Br on the sleeve. In this Figure the sleeve 3 is horizontally fixed, and the magnet roller 13 is rotatably supported in the sleeve 3. The axial probe 17 is mounted with a small clearance from the sleeve 3 in the manner that the center of the sleeve 3 and the center of the probe are at the same level. It is connected with the gauss meter 16 to detect the magnetic flux density in the radial direction of the sleeve. The sleeve 3 and the magnet roller 13 are concentric, so that the clearance between the sleeve 3 and the magnet roller 13 is the same at any circumferential point. By rotating the magnet roller 13, the magnetic flux density Br at any circumferential position can be measured.

Figure 5:
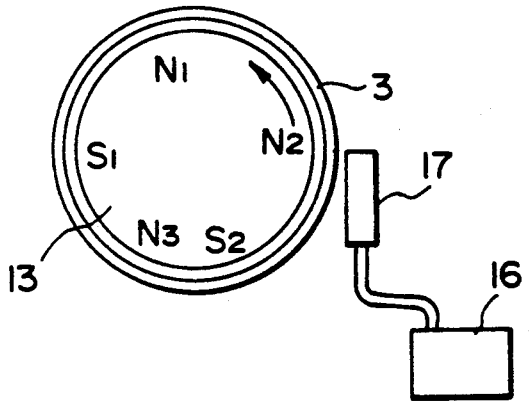
FIG. 5 illustrates, measuring method of a magnetic flux density in the direction tangential to the surface of the sleeve.

FIG. 5 illustrates the measurement of the magnetic flux density $B\theta$ on the sleeve 3 in the tangential direction thereof. The axial probe 17 is vertically fixed with a slight clearance from the sleeve 3 so that the center of the sleeve 3 and the measuring center of the probe are substantially at the same level. It is connected with the Gauss meter to detect the magnetic flux density $B\theta$ on the sleeve 3. Similarly to FIG. 4, by rotating the magnet roller 13 in the direction of the arrow, the magnetic flux density $B\theta$ at any circumferential position can be detected.

Table 2 is the experimental results regarding the conveying performance and the developer scattering of the first conveying magnetic pole, using the developing rollers of the dimensions of Table 1.

Embodiment 4 in Table 2 is such that the developing device of the structure of FIG. 1 is additionally provided with a scatter preventing member, which will be described in detail hereinafter.

TABLE 1

| | |
|---|---|
| Outer diameter of the sleeve | 32 mm |
| Peripheral speed of the photosensitive member | 160 mm/sec |
| Peripheral speed of the developing sleeve | 160 mm/sec |

TABLE 2

| | Embodiment 1 | Embodiment 2 | Embodiment 3 | Embodiment 4 | Comparison Example |
|---|---|---|---|---|---|
| Max. Flux Density (Gauss) | | | | | |
| Dev. pole | 1010 | 1020 | 1000 | 1000 | 1030 |
| 1st pole | 550 | 540 | 550 | 550 | 540 |
| 2nd pole | 540 | 530 | 540 | 540 | 530 |
| Angle (deg.) $B_F(S1) - B_F(N1)$ | 82 | 82 | 73 | 73 | 79 |
| Angle (deg.) $B_F(N1) - B_F(N2)$ | 94 | 95 | 101 | 101 | 94 |
| 1st Pole | | | | | |
| $K_A$ (deg.) | 98 | 97 | 98 | 98 | 98 |
| $K_P$ (deg.) | 53 | 52 | 44 | 44 | 46 |
| Inflection P | yes | yes | yes | yes | no |
| $F\theta$ min [nwtn] | $-1.0\times10^{-7}$ | 0 | $-1.0\times10^{-7}$ | $-1.0\times10^{-7}$ | $+1.0\times10^{-7}$ |
| Scatter preventing member | no | no | no | yes | no |
| Conveying performance by 1st pole | good | good fair | good | good | no good |
| Scatter preventing performance | good | good | good fair | good | fair |

It will be understood that by the provision of the inflection point upstream of the magnetic flux density position in the magnetic flux density distribution of the first conveying pole N1, as in Embodiments 1–4, the conveying power thereof is improved. When the minimum of the magnetic force $F\theta min$ of the magnetic force $F\theta$ at the first conveying pole is negative as in the embodiments 1 and 3, the magnetic force has the component in the direction of the developer conveyance, therefore, the conveying power is further improved.

It is also understood that if the maximum magnetic flux density position $B_P(N1)$ of the first conveying magnetic pole N1 is downstream of the center of the first conveying pole ($\frac{1}{4}K_A$), that is, $K_P > (\frac{1}{4})K_A$), so that it is remote from the developing pole position, the amount of the scattered developer is very small.

Figure 6:
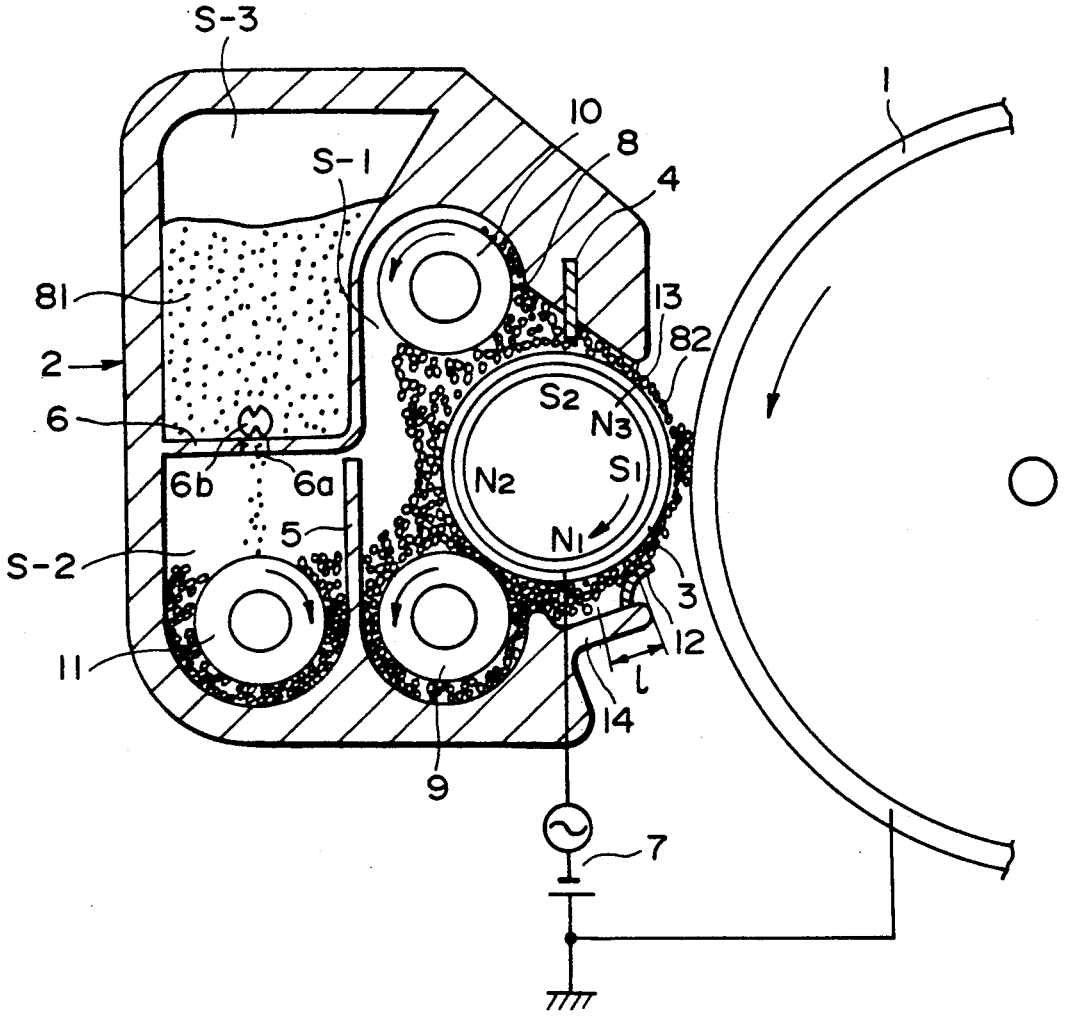
FIG. 6 is a cross-sectional view of an apparatus according to another embodiment of the present invention.

The magnet of Example 3 was used, and the developing apparatus shown in FIG. 6 was used in Example 4. More particularly, to the developing apparatus used in Example 2, an elastically flexible member 12 made of polyethylene terephthalate film or the like is mounted to prevent the scattering.

embodiment, that the provision of the inflection point in the magnetic flux density distribution of the first conveying pole upstream of the maximum magnetic flux density position $B_P(N1)$, is effective to improve the conveying power by the first conveying pole. The reason for this is considered as being the same.

Table 4 is the experimental results regarding the conveying performance and the developer scattering of the first conveying magnetic pole, using the developing rollers of the dimensions of Table 3.

Embodiment 4 in Table 2 is such that the developing device of the structure of FIG. 1 is additionally provided with a scatter preventing member, which will be described in detail hereinafter.

TABLE 3

| | |
|---|---|
| Outer diameter of the sleeve | 20 mm |
| Peripheral speed of the photosensitive member | 160 mm/sec |
| Peripheral speed of the developing sleeve | 210 mm/sec |

TABLE 4

| | Embodiment 5 | Embodiment 6 | Embodiment 7 | Embodiment 8 | Comparison Example 2 |
|---|---|---|---|---|---|
| Max. Flux Density (Gauss) | | | | | |
| Dev. pole | 1020 | 1000 | 1010 | 1010 | 1030 |
| 1st pole | 550 | 540 | 560 | 560 | 540 |
| 2nd pole | 530 | 530 | 540 | 540 | 520 |
| Angle (deg.) $B_P(S1) - B_P(N1)$ | 83 | 82 | 72 | 72 | 78 |
| Angle (deg.) $B_P(N1) - B_P(N2)$ | 94 | 95 | 102 | 102 | 95 |
| 1st Pole | | | | | |
| $K_A$ (deg.) | 98 | 97 | 98 | 98 | 98 |
| $K_P$ (deg.) | 52 | 53 | 44 | 44 | 47 |
| Inflection P | yes | yes | yes | yes | no |
| Scatter preventing member | no | no | no | yes | no |
| Conveying performance by 1st pole | good | good | good | good | no good |
| Scatter preventing performance | good | good | good fair | good | fair |

An end of the scattering preventing member 12 is fixed to the covering member 14, and the other end is a free end. The surface thereof at the free end is lightly contacted to the developer at a position upstream of the maximum magnetic flux density position $B_P(N1)$ by the conveying pole.

Without the scattering preventing member, the scattering of the developer was at a tolerable level, but the provision of the member further decreases the scattering to an excellent extent.

As regards the developer conveying performance, it was as good as in Example 2.

Figure 7:
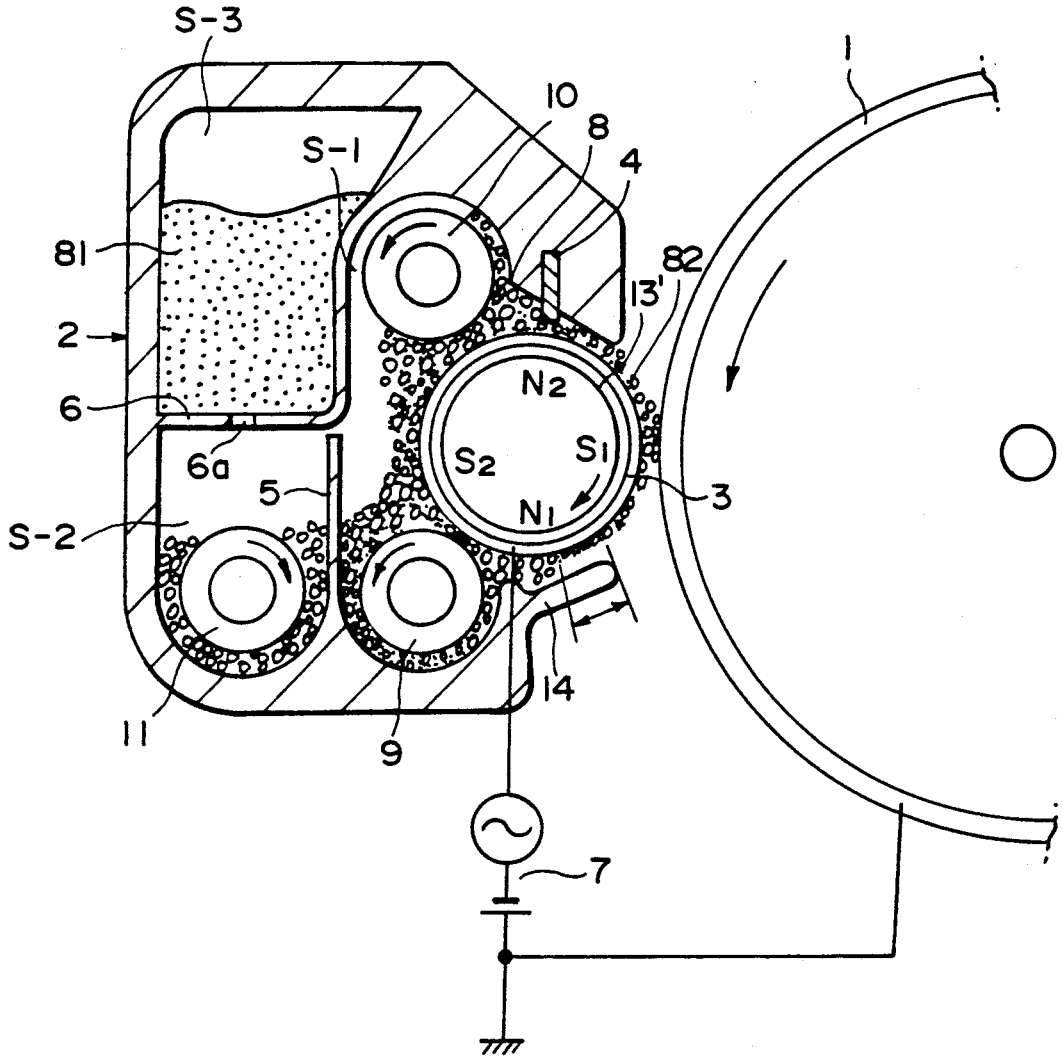
FIG. 7 is a cross-sectional view of an apparatus according to a further embodiment of the present invention.

In the foregoing embodiment, the first conveying pole and the second conveying pole have the same magnetic polarity. However, the present invention is applicable to the case wherein the magnet has the second conveying pole S1 having the polarity opposite from that of the first conveying pole N1, as shown in FIG. 7. The structure of FIG. 7 apparatus is the same as that of the FIG. 1 apparatus, except for the position of the magnetic pole of the magnet 13'.

Figure 8:
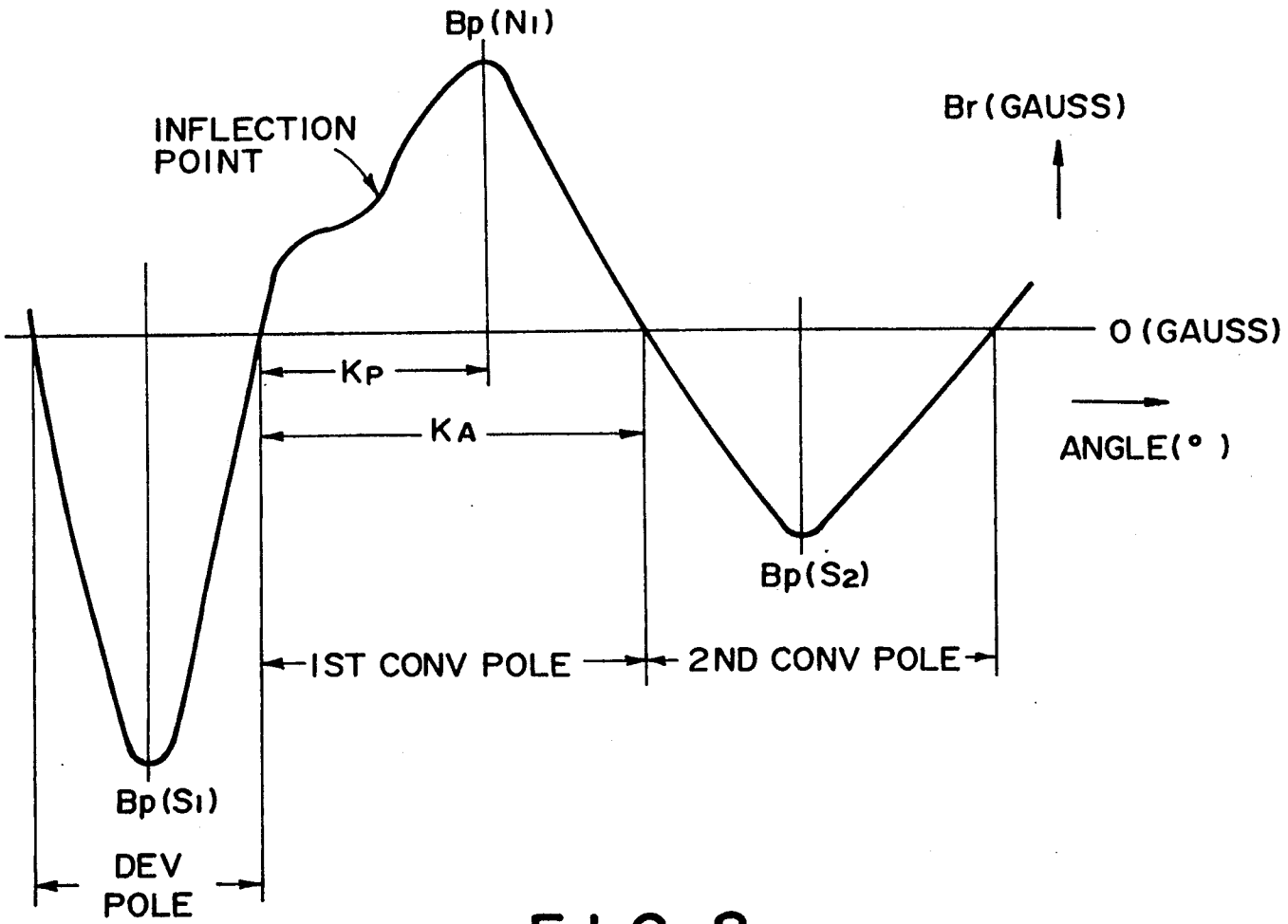
FIG. 8 shows an example of a magnetic flux density distribution of a magnet used in the apparatus of FIG. 7.

FIG. 8 shows the distribution of the radial magnetic flux density Br on the sleeve surface, of the magnet 13. It has been emprically confirmed as in the foregoing In embodiment 8, the scatter preventing member 12 shown in FIG. 6 is sued in the apparatus of FIG. 8.

In the comparison example 2, wherein the inflection point disposed in the magnetic flux density distribution of the first conveying pole upstream of hte maximum mfd, the conveying power of the fcp is poor, and the developer is stagnated and overflown or scattered. With the provision of the ip, the developer is not overflown, and does not scatter.

It is also understood that if the maximum magnetic flux density position $B_P(N1)$ of the first conveying magnetic pole N1 is downstream of the center of the first conveying pole ($\frac{1}{4}K_A$), that is, $K_P > (\frac{1}{4})K_A$), so that it is remote from the developing pole position, the amount of the scattered developer is very small.

The magnetic flux density distributions described above may be obtained by bonding plural magnets in proper orientations, by magnetizing a roller in proper patterns or by cutting away a part of magnet roller or the like.

In the foregoing embodiments, a so-called pole position development has been dealt with wherein the developing operation is performed wherein the brush is erected by the developing pole. However, the present invention is applicable to the case of a so-called between-poles development wherein the closest position between the sleeve and the drum is placed between two magnetic poles having opposite polarities to form a laid-down magnetic brush without direct contact to the drum.

In this case, the downstream one of the developing magnetic poles sandwiching the closest position and a magnetic pole downstream of the downstream developing pole are made to satisfy the relation described in the foregoing.

The present invention is also applicable to a developing apparatus using a developer which a mixture of magnetic toner and small size magnetic carrier particles. Further, the present invention is applicable to a one component magnetic developer. Therefore, the present invention is applicable to a developing device using a developer containing magnetic materials.

While the invention has been described with reference to the structures disclosed herein, it is not confined to the details set forth and this application is intended to cover such modifications or changes as may come within the purposes of the improvements or the scope of the following claims.

What is claimed is:

1. A developing apparatus for developing an electrostatic latent image formed on an image bearing member, comprising:

a developer container for containing a developer comprising magnetic material;

a rotatable developer carrying member for being supplied with the developer in said developer container and for carrying the developer through a developing zone where said developer carrying member is faced to said image bearing member;

a magnet stationarily disposed in said developer carrying member, wherein said magnet has a first magnetic pole for forming a magnetic field in the developing zone, a second magnetic pole disposed adjacent to said first magnetic pole and downstream of said first magnetic pole with respect to a rotational direction of said developer carrying member and having a magnetic polarity opposite to that of said first magnetic pole, and a third magnetic pole disposed downstream of said second magnetic pole with respect to the direction and disposed adjacent to said second magnetic pole, wherein said second magnetic pole has such a magnetic flux density distribution that it has an inflection point upstream of a maximum magnetic flux position of said second magnetic pole with respect to a movement direction of said developer carrying member.

2. An apparatus according to claim 1, wherein said first magnetic pole has a maximum magnetic flux density which is larger than that of said second magnetic pole.

3. An apparatus according to claim 2, wherein a maximum magnetic flux density position of said second magnetic pole is downstream of a center of said second magnetic pole with respect to the movement direction.

4. An apparatus according to claim 2, wherein a magnetic force of said second magnetic pole has a component codirectional with movement direction of said developer carrying member.

5. An apparatus according to claim 2, wherein said third magnetic pole has the same polarity as the second pole.

6. An apparatus according to claim 2, wherein said third magnetic pole has the opposite polarity as the second pole.

7. An apparatus according to any one of claims 1–6, further comprising a covering member extending upstream beyond the maximum magnetic flux density position of the second magnetic pole with respect to the direction to cover the developer carrying member.

8. An apparatus according to any one of claims 1–6, further comprising a flexible sealing member contactable to a layer of the developer carried on said developer carrying member at its free end portion at a position upstream of the maximum magnetic flux density position of the second magnetic pole.

9. An apparatus according to any one of claims 1–6, wherein said developer carrying member carries the developer comprising toner particles and the magnetic carrier particles having a weight average particle size of 20–65 microns.

10. An apparatus according to claim 9, wherein the toner particles have a volume average particle size not more than 8 microns.

11. A developing apparatus according to claim 10, further comprising a voltage source for applying an oscillating bias voltage to said developer carrying member.

* * * * *

UNITED STATES PATENT AND TRADEMARK OFFICE

CERTIFICATE OF CORRECTION

PATENT NO. : 5,129,357 Page 1 of 3

DATED : July 14, 1992

INVENTOR(S) : Yamaji

It is certified that error appears in the above-identified patent and that said Letters Patent is hereby corrected as shown below:

On the title page, Item

[56] REFERENCES CITED:

"Barlow, Jr., J. E." should read --J. E. Barlow, Jr.--.

COLUMN 1:

Line 31, "pole"." should read --pole)."
Line 44, "the" (second occurrence) should be deleted.
Line 45, "age," should read --ages,--.
Line 49, "result in" should be deleted; and "decrease." should read --decreases.--.

COLUMN 2:

Line 3, "when" should read --with--.
Line 50, "object" should read --objects--.
Line 66, "illustrates," should read --illustrates a--.

COLUMN 3:

Line 14, "On" should read --An--.

COLUMN 4:

Line 4, "comprises" should read --comprising--.
Line 18, "to" should read --is--.
Line 20, "is" should be deleted.
Line 36, fill to right margin.
Line 37, fill to left margin.

UNITED STATES PATENT AND TRADEMARK OFFICE

CERTIFICATE OF CORRECTION

PATENT NO. : 5,129,357

DATED : July 14, 1992

INVENTOR(S) : Yamaji

It is certified that error appears in the above-identified patent and that said Letters Patent is hereby corrected as shown below:

COLUMN 5:

Line 8, "particles. Additionally, the surface of" should read --particles and--.
Line 36, "out side" should read --outside--.
Line 62, "support 6a," should read --supply port 6a,--.

COLUMN 6:

Line 64, "is" should read --and is--.

COLUMN 7:

Line 5, "BP(N1)" should read --Bp(N1)--.
Line 9, "$\theta^2Br/\theta^2\theta$," should read --$\delta^2Br/\delta^2\theta$,--.
Line 11, "the" (second occurrence) should be deleted.
Line 28, "are" should read --is--.
Line 42, "magnetic" should read --mo: magnetic--.
Line 45, "b" should read --b:--.
Line 46, "Br" should read --Br:--.

COLUMN 8:

Line 10, "fairly" should be deleted.
Line 11, "oping," should read --oping--.
Line 30, "incorporated." should read --Incorporated.--.
Line 32, "downstream" should read --downstream direction--.

COLUMN 11:

Line 12, "$Kp>(\frac{1}{4})K_A$)," should read --$Kp>(\frac{1}{2})K_A$,--.

UNITED STATES PATENT AND TRADEMARK OFFICE

CERTIFICATE OF CORRECTION

PATENT NO. : 5,129,357 Page 3 of 3

DATED : July 14, 1992

INVENTOR(S) : Yamaji

It is certified that error appears in the above-identified patent and that said Letters Patent is hereby corrected as shown below:

COLUMN 12,:

Line 46, "sued" should read --used--.
Line 49, "hte" should read --the--.
Line 51, "overflown" should read --overflowed--.
Line 53, "flown," should read --flowed,--.
Line 57, "($\frac{1}{4}K_A$), that is, $Kp>(\frac{1}{4})K_A$)," should read --($\frac{1}{2}K_A$), that is, $Kp>(\frac{1}{2})K_A$),--

COLUMN 13:

Line 36, "member;" should read --member; and--.

COLUMN 14:

Line 23, "as" should read --to--.

Signed and Sealed this

Seventh Day of December, 1993

*Attest:*

Bruce Lehman

BRUCE LEHMAN

*Attesting Officer*

*Commissioner of Patents and Trademarks*